United States Patent [19]

Diven

[11] 4,164,949

[45] Aug. 21, 1979

[54] ASH TRAP FOR A BONG

[75] Inventor: Jeffrey K. Diven, Wheaton, Md.

[73] Assignee: McCall Associates, Inc., Rockville, Md.

[21] Appl. No.: 872,260

[22] Filed: Jan. 25, 1978

[51] Int. Cl.[2] ..... A24F 1/30

[52] U.S. Cl. ..... 131/173; 131/231

[58] Field of Search ..... 131/173, 171 R, 231

[56] References Cited

U.S. PATENT DOCUMENTS

| | | | |
|---|---|---|---|
| 77,096 | 4/1868 | Robbins | 131/173 |
| 848,424 | 3/1907 | Abizaid | 131/173 |
| 3,881,499 | 5/1975 | McFadden | 131/173 |
| 4,014,353 | 3/1977 | Kahler | 131/173 |
| 4,029,109 | 6/1977 | Kahler | 131/231 |

*Primary Examiner*—Stephen C. Pellegrino

*Attorney, Agent, or Firm*—Bernard Stickney

[57] ABSTRACT

An ash trap for a bong having a chamber with an intermediate perforate disc. A smoke passage tube extends from a smoke material bowl through the side of the chamber and the disc into a lower chamber. Ashes are collected on a removable closure at the end of the lower chamber. Tubing to a bong may be secured to the upper portion of the first chamber.

5 Claims, 6 Drawing Figures

ASH TRAP FOR A BONG

BACKGROUND OF THE INVENTION

The present invention relates to an improved ash trap particularly adapted for use with bongs. A bong which is a water cooled smoking device has a long history of development and use and has become very popular in recent years. Its history as set forth in U.S. Pat. No. 3,881,499 to McFadden et al, owned by the assignee of this invention, is incorporated herein by reference thereto. The foregoing discloses a bong having an ash trap chamber located beneath a water chamber with primary tubing to the trap and secondary tubing from the trap to the water chamber.

Accordingly it is the primary object of this invention to provide an improved ash trap which may be conveniently located adjacent to the water chamber of a bong for ready removal of the ashes.

Another object of this invention is to provide an improved ash trap for preventing contamination of the water in a bong.

A further object of this invention is to provide an ash trap which may directly be connected to a smoke material bowl and requires only the removal of a bottom closure to release the ashes.

A still further object of this invention is to provide an ash trap of a simple, sturdy and economical construction.

BRIEF DESCRIPTION OF THE DRAWINGS

These and other objects and advantages of the invention will subsequently become apparent from the following detailed description when read in conjunction with the accompanying drawings wherein.

DETAILED DESCRIPTION OF THE INVENTION AND DRAWINGS

Figure 1:
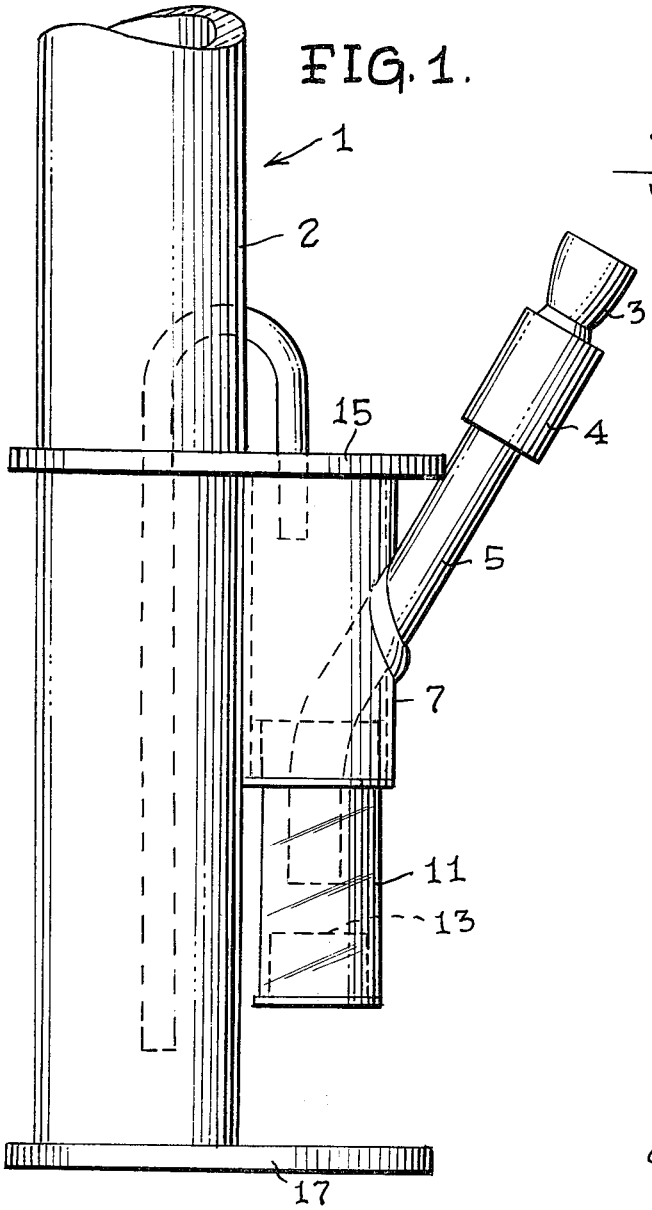
FIG. 1 is a side view of a bong incorpating the ash trap of the invention.
Figure 2:
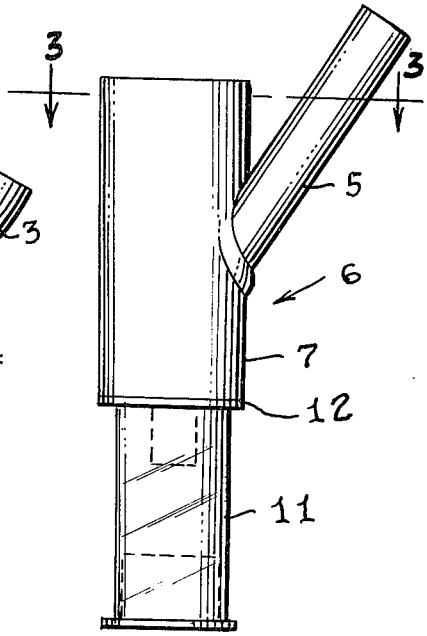
FIG. 2 is a side view of the ash trap.
Figure 3:
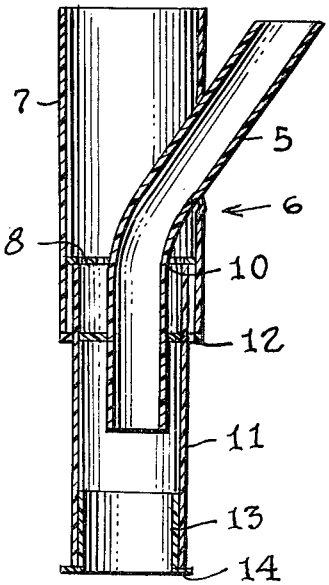
FIG. 3 is a cross-sectional view taken along the line 3—3 of FIG. 2.
Figure 6:
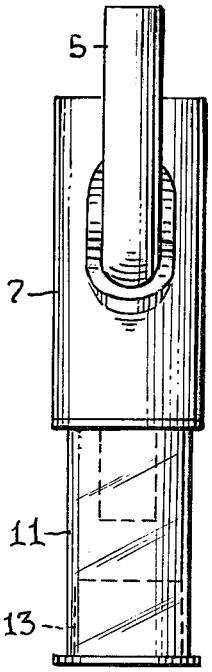
FIG. 6 is a frontal view of the ash trap.

Referring now more specifically to the drawings, FIG. 1 shows a generally indicated bong 1 having a water chamber 2 and a smoke material bowl 3 which is preferably made of ceramic or refractory material. The bowl is connected by a collar 4 to tubing 5 of the ash trap of the invention, generally indicated at 6 and located adjacent the water chamber 2 as shown in FIG. 1. The tubing 5 is bent and enters through the wall of an upper cylindrical chamber 7 as shown in FIGS. 1 and 3.

Figure 4:
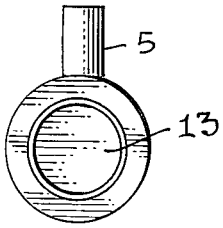
FIG. 4 is a view from the bottom of the ash trap.
Figure 5:
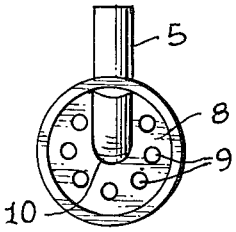
FIG. 5 is a view looking down upon the ash trap of FIG. 2.

A perforated disc 8, best seen in FIG. 5, having holes 9, an opening 10 through which tubing 5 passes, is located horizontally within chamber 7. The ring 12 serves as a smoke seal for chamber 7 and to frictionally retain chamber 11 which may be removed for cleaning and to more readily reach disc 8 for cleaning. A lower cylindrical chamber 11 abuts the disc 8 as in FIG. 3. A washer-like ring 12 closes the lower end of chamber 7. As shown in FIGS. 3 and 4, a removable hollow closure cap 13 having a gripping rim 14 is friction fitted within the lower end of chamber 11. To complete the bong, a plate 15 with tubing 16 extending through it seals the upper portion of chamber 7. Tubing 16 in this simplified version extends into chamber 2 to be well below the level of the water placed therein. Plate 17 serves as a base for the bong.

The foregoing bong operates in the usual manner by burning smoke materials in bowl 3. Smoke, ashes and other contaminants pass through tubing 5 to chamber 11 where the ash and contaminants are deposited on closure 13 while the smoke continues up through the perforate disc 8 into the upper chamber 7 and through tubing 15 into the water in chamber 2 for its cooling effect. Inhalation is obtained at the upper end of chamber 2.

It is to be recognized that chambers 7 and 11 constitute in function a unitary smoke and air mixing chamber which serves to cool the smoke prior to its entrance into the water in addition to being an ash trap. In a preferred construction, the parts are made of plastics, such as acrylic resins. For large bongs as shown in FIG. 1, chamber 7 may be made of one inch tubing with $\frac{1}{4}$ inch walls while chamber 11 is a thinner walled $\frac{3}{4}$ inch tubing. The combined overall length of chambers as shown is four inches. All parts are joined securely to form an air tight continuity from the bowl to the water chamber. For aesthetic appeal, tubing 5 and chamber 7 may be ebony black which chamber 11 is transparent and ring 12 and cap 13 a bright yellow.

Obviously the present invention can be used in combination with various types of bongs. One arm currently in use is the double water chamber in which two tubes are introduced at the top of the upper chamber of the ash trap. The tubes lead to separate water chambers which ultimately combine to vertical water chamber with smoking end. The smoking chamber and ash trap in reduced form can also be the basis of a conventional smoking pipe.

The advantages of the invention are self evident from the foregoing description. Ash and other contaminants will be prevented from contaminating the water in a bong, while assisting in providing a cool smoke and allowing for easy removal of the ashes. Other modifications and variations may be made in the details of construction such as making the trap in a unitary chamber, but it is understood that such changes will be made within the spirit and scope of the present invention.

I claim:

1. In a bong having a water chamber, the combination of a smoke chamber adjacent the water chamber, perforate means within said smoke chamber, a separate ash trap chamber removably secured below said smoke chamber and extending upwardly into it in abutment with said perforate means, a bowl for smoke materials connected to a smoke passage means which extends through a wall of the smoke chamber and through an opening in the perforate means into the ash trap chamber, removable means for collecting ashes in the lower portion of the ash trap chamber, and second smoke passage means connecting an upper portion of the smoke chamber to the water chamber whereby smoke and ashes will pass from the bowl to the lower portion of the ash chamber while smoke alone will pass through the perforate means surrounding said first smoke passage means into the smoke chamber and to the water chamber.

2. A bong as defined in claim 1, wherein the perforate means is a disc with holes, extending transversely across the smoke chamber.

3. A bong as defined in claim 1, wherein the removable means is a friction fitted cap.

4. A bong as defined in claim 1, wherein the first smoke passage means is bent tubing passing through a side wall of the smoke chamber and then through the center of the perforate means.

5. An ash trap as defined in claim 1, wherein the smoke chamber comprises:

a first cylinder within which the perforate means is located, and a second cylinder within the first cylinder and abutting the perforate means.

* * * * *